US007222638B1

(12) United States Patent
Wong et al.

(10) Patent No.: US 7,222,638 B1
(45) Date of Patent: May 29, 2007

(54) VORTEX MINIMIZING FLUID GATHERING AND TRANSFERRING APPARATUS

(76) Inventors: Kau-Fui Vincent Wong, 8215 SW. 18th St., Miami, FL (US) 33155; James R. McNew, 112 Bahama Rd., Key Largo, FL (US) 33037; Eudoro Lopez, 10477 SW. 108th Ave., Miami, FL (US) 33176

( * ) Notice: Subject to any disclaimer, the term of this patent is extended or adjusted under 35 U.S.C. 154(b) by 156 days.

(21) Appl. No.: 11/139,278

(22) Filed: May 27, 2005

(51) Int. Cl.
*E03C 1/18* (2006.01)

(52) U.S. Cl. ..... 137/578; 137/544; 137/582; 137/590

(58) Field of Classification Search ..... 137/544, 137/550, 578, 582, 590
See application file for complete search history.

(56) References Cited

U.S. PATENT DOCUMENTS 1,982,062 A * 11/1934 Matthews ..... 137/433
5,279,323 A * 1/1994 Grove et al. ..... 137/154
6,014,987 A * 1/2000 List et al. ..... 137/549
7,089,607 B2 * 8/2006 Barnes et al. ..... 4/508
2003/0196705 A1 * 10/2003 Grayson ..... 137/590
2004/0164031 A1 8/2004 Reber

* cited by examiner

*Primary Examiner*—A. Michael Chambers
(74) *Attorney, Agent, or Firm*—Frank L. Kubler

(57) ABSTRACT

A liquid gathering and transferring apparatus for gathering liquid from a liquid source containing a quantity of liquid having a liquid surface and containing debris and discharging the liquid into a liquid receiving location includes an intake chamber having a chamber discharge end in fluid communication with the liquid receiving location and a chamber structural end opposite the chamber discharge end and a chamber side wall extending between the chamber discharge end and the chamber structural end and a longitudinal series of liquid intake ports in the chamber side wall extending generally between the chamber discharge end and the chamber structural end, the intake ports being of generally increasing diameter along the chamber side wall toward the chamber structural end for minimizing liquid vortex formation at the intake ports; so that the intake chamber can be suspended below the liquid surface at a minimal depth where less debris is present and draw liquid with negligible vortex formation.

12 Claims, 5 Drawing Sheets

VORTEX MINIMIZING FLUID GATHERING AND TRANSFERRING APPARATUS

FILING HISTORY

This application is based at least in part on the contents of Disclosure Document Number 558086 filed on Aug. 2, 2004.

BACKGROUND OF THE INVENTION

1. Field of the Invention

The present invention relates generally to the field of fluid gathering and transferring devices. More specifically the present invention relates to a liquid gathering and transferring apparatus which draws a stream of liquid from a quantity of liquid such as a body of water containing debris while minimizing or eliminating the formation of liquid vortices which can draw debris to and thus obstruct apparatus intake ports. The apparatus includes an intake chamber having a chamber discharge end in fluid communication with a liquid receiving location and liquid drawing means and a chamber structural end opposite the chamber discharge end and a chamber side wall extending between the chamber discharge end and the chamber structural end and having at least one longitudinal series of liquid intake ports arrayed between the chamber discharge end and the chamber structural end and in fluid communication with liquid at a source location such as a body of water containing debris, at least some of the intake ports being of increasing diameter in the direction of the chamber structural end to minimize or eliminate vortex formation at the intake ports. The chamber structural end may or may not include one or more intake ports. The increase in intake port diameter may or may not be uniform and progressive. An intake float structure preferably is provided for buoying the intake chamber to a position below and close to the liquid surface and for orienting the intake ports relative to the liquid surface as desired for the given application. The liquid drawing means, which can be a liquid pump or the force of gravity, is provided in fluid communication with the chamber discharge end lowers liquid pressure within the intake chamber creating a pressure difference between liquid outside the intake chamber and liquid inside the intake chamber and thus causing liquid to flow into the chamber through the intake ports.

Intake flow is distributed among the several intake ports, while the increasing diameters minimize or eliminate the formation of vortices at the minimal depth at which the intake chamber is positioned. For example, vortices can be virtually or entirely eliminated with this structure by submerging the intake ports to a depth of perhaps six inches for a liquid gathering rate of 1000 gallons per minute, while a depth of fifty-six inches may be required for prior liquid gathering devices having uniform diameter intake ports.

2. Description of the Prior Art

There have long been water gathering devices having one or more intake ports for gathering water from a source location and discharging it at a liquid receiving location. A problem with these prior devices has been that, when intake ports are placed close to the water surface, vortices form at the intake ports which attract debris and reduce or stop the flow. And since the concentration of debris typically is greater at greater depth, submerging the ports deep enough to prevent vortex formation places the intake ports into a region of high debris concentration, once again leading to obstructed flow. Despite this result, deep submersion seems to be the favored approach in the existing art.

Reber, Publication No. U.S. 2004/0164031, published on Aug. 26, 2004, discloses a submerged water inlet strainer for a water hose. One embodiment of Reber includes a hollow structure which is mostly closed and fitted with a first opening connected to a water drawing hose and a second opening covered by sieve-like material. The hollow structure is intended to rest on a "flat, solid bed" of a "clean" body of water and drawing water while keeping out foreign objects. Thus Reber does not address the problems of drawing water from a water source containing substantial quantities of debris without clogging.

It is thus an object of the present invention to provide a liquid gathering and transferring apparatus which gathers liquid through several intake ports in an intake chamber from a source location close to the liquid surface, and yet does so with negligible vortex formation so that substantially no debris from the source liquid is drawn to the intake ports to obstruct flow.

It is another object of the present invention to provide such a liquid gathering and transferring apparatus which minimizes vortex formation by providing an intake chamber having a chamber discharge end and a chamber structural end and a chamber side wall extending between the chamber discharge end and chamber structural end and having intake ports arrayed in a longitudinal series along the chamber side wall with progressively increasing diameters in the direction of the chamber structural end.

It is still another object of the present invention to provide such a liquid gathering and transferring apparatus which can be adapted for a variety of practical applications, including draining flood water, extracting drinking water from a lake, drawing a layer of oil off the surface of a body of water, pumping leaked water out of a ship such as by connecting the apparatus to a ship pump and passing a stream of debris-free water through a dam.

It is finally an object of the present invention to provide such a liquid gathering and transferring apparatus which is easy to use, reliable and economical to manufacture.

SUMMARY OF THE INVENTION

The present invention accomplishes the above-stated objectives, as well as others, as may be determined by a fair reading and interpretation of the entire specification.

A liquid gathering and transferring apparatus is provided for gathering liquid from a liquid source containing a quantity of liquid having a liquid surface and containing debris and discharging the liquid into a liquid receiving location, the apparatus including an intake chamber having a chamber discharge end in fluid communication with the liquid receiving location and a chamber structural end opposite the chamber discharge end and a chamber side wall extending between the chamber discharge end and the chamber structural end and at least one longitudinal series of liquid intake ports in the chamber side wall extending generally between the chamber discharge end and the chamber structural end, the intake ports being of generally increasing diameter along the chamber side wall toward the chamber structural end for minimizing liquid vortex formation at the intake ports; so that the intake chamber can be suspended below the liquid surface at a minimal depth where less debris is present and draw liquid with negligible vortex formation.

The intake chamber side wall preferably is substantially tubular. The intake chamber preferably is oriented in a substantially horizontal position having a chamber downward surface and the intake ports are arrayed along the chamber side wall downward surface and having a chamber upward surface, the apparatus additionally including a liquid pump in fluid communication with the chamber discharge end; a liquid transmitting conduit extending from the chamber discharge end to the liquid receiving location; and a buoying structure connected to and buoying the intake chamber to a position in which the intake ports are below and substantially adjacent to the liquid surface. The liquid transmitting conduit preferably is flexible.

The buoying structure optionally includes an intake chamber float structure. The intake chamber float structure preferably includes a buoyant barrier loop within which the intake chamber is mounted for blocking floating debris from reaching the intake ports. The intake float structure preferably additionally includes a float structure upper portion and a top panel extending across the float structure upper portion and thereby closing the barrier loop. The intake float structure optionally includes at least one float tube having a float tube closed end and being linked to the intake chamber for positioning the chamber upward surface within a layer of oil on the liquid surface, and the intake ports are arrayed along the chamber upward surface for drawing oil from the layer of oil. The intake float structure optionally includes at least one said float tube. The buoying structure preferably includes buoyant material secured to the intake chamber so that the intake chamber is made buoyant.

A liquid gathering apparatus is further provided for gathering liquid from a stream containing a quantity of flowing liquid having a liquid surface and containing debris, the apparatus including an intake chamber having a chamber discharge end and a chamber structural end opposite the chamber discharge end and a chamber side wall extending between the chamber discharge end and the chamber structural end and a longitudinal series of liquid intake ports in the chamber side wall extending generally between the chamber discharge end and the chamber structural end, the intake ports being of generally increasing diameters along the chamber side wall toward the chamber structural end for minimizing vortex formation at the intake ports; so that the intake chamber can be suspended below and in close proximity to the liquid surface where less debris is present and draw liquid with substantially no vortex formation; and a dam extending across and blocking flow of a stream of liquid, the dam having a water upstream side defining the liquid source location and trapping liquid containing debris and having a water downstream side defining a liquid receiving location where the intake chamber is positioned on the water upstream side and the chamber discharge end is in fluid communication with the liquid receiving location, and having a liquid transmitting conduit extending through the dam from the water upstream side to the water downstream side and opening into the water downstream side below the level of the intake ports, so that gravity drives water into the intake chamber and through the liquid transmitting conduit and through the dam to the water downstream side; so that debris is retained within the water upstream side and only substantially debris-free water passes to the water downstream side. The liquid transmitting conduit preferably includes a dam pipe passing through the dam from the water upstream side to the water downstream side and a flexible hose segment extending from the intake chamber to the dam pipe.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
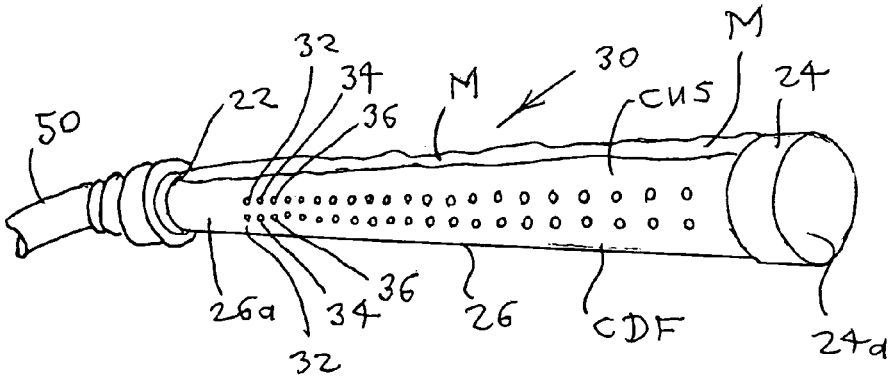
FIG. 1 is a side perspective view of a preferred intake chamber having at least two parallel series of intake ports and part of a liquid transmitting conduit.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

The Invention Generally

Figure 2:
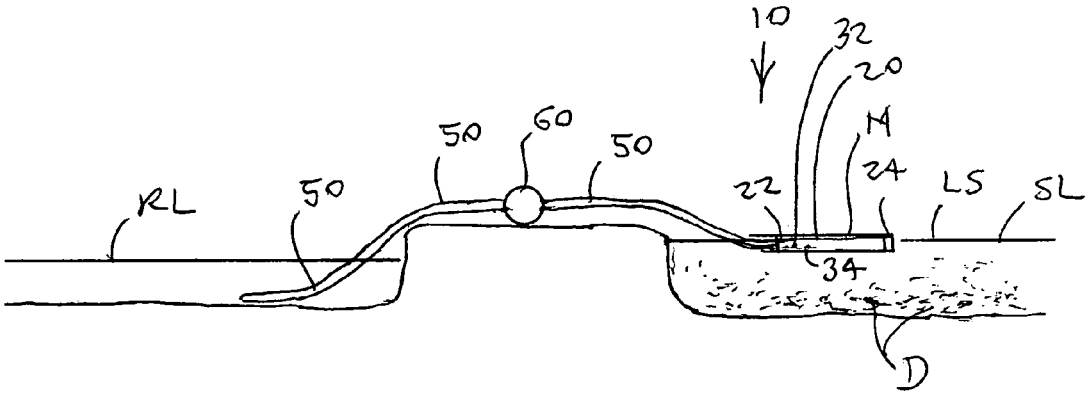
FIG. 2 is a side view of the entire apparatus including the intake chamber supported by a float structure within a liquid source location, a liquid transmitting conduit including a pump and leading to a liquid receiving location.
Figure 3:
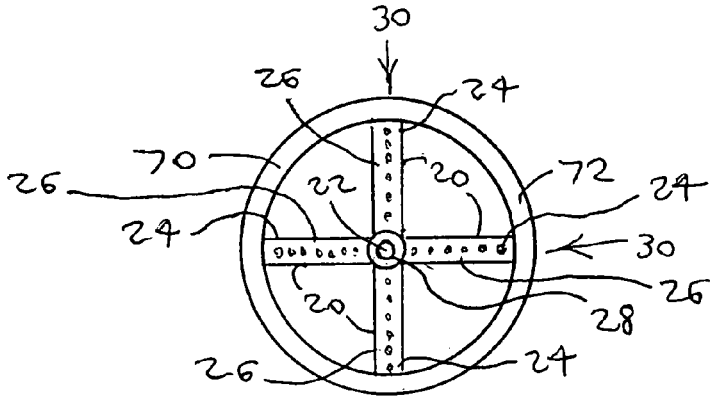
FIG. 3 is a bottom view of an embodiment of the intake chamber having four radial intake chamber segments extending from a chamber hub portion and mounted within a loop float structure.
Figure 4:
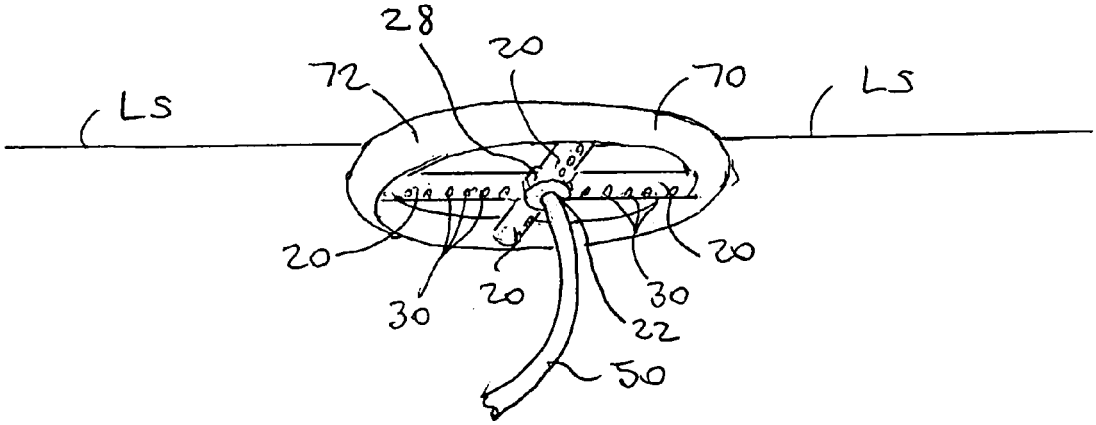
FIG. 4 is a lower perspective view of an intake chamber and float apparatus as in FIG. 3 floating on a liquid surface and of a portion of a liquid transmitting conduit extending downwardly from the chamber hub portion.
Figure 5:
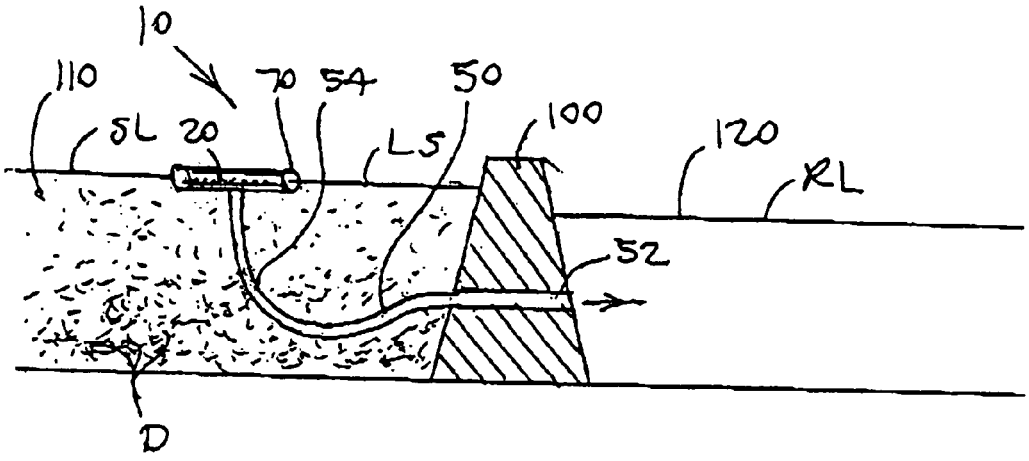
FIG. 5 is a cross-sectional side view of the dam embodiment of the apparatus showing water containing debris on the upstream side and clearer water on the dam downstream side, and the dam pipe extending through the dam connected to the intake chamber hub portion with a flexible hose.
Figure 6:
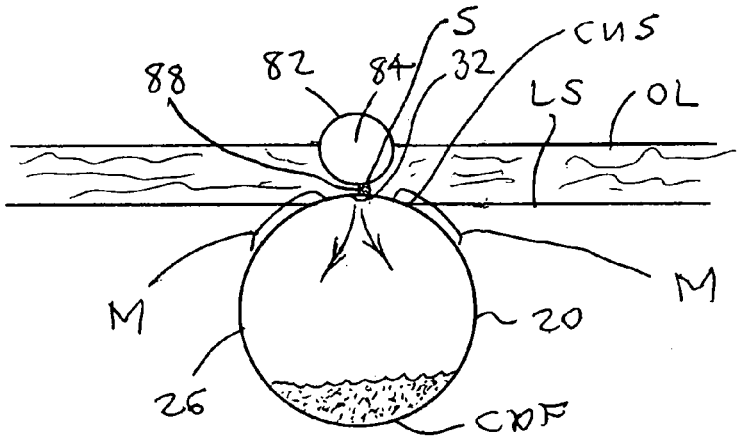
FIG. 6 is a cut-away end view of a tubular intake chamber with the intake ports in its upper surface for skimming oil from an oil layer and supported at the water surface by a float tube which also functions as a boom.
Figure 7:
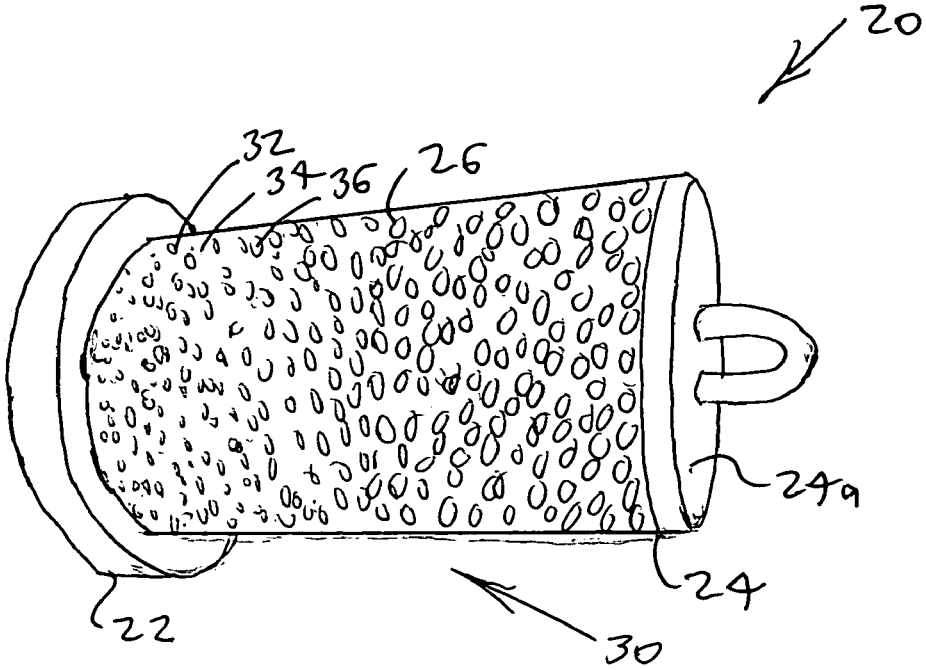
FIG. 7 is a side perspective view of an intake chamber similar to that of FIG. 1 but having a smaller length to width ratio. This is a variation of a pre-existing uniform intake port size strainer which is altered to have intake ports of increasing diameter from the chamber discharge end to the chamber structural end. Buoyant material, although not shown in this FIGURE, may be added. The buoyant material may be omitted where the body of water is so shallow that the intake chamber does not exceed the desired depth when resting on the bottom of the body of water.
Figure 8:
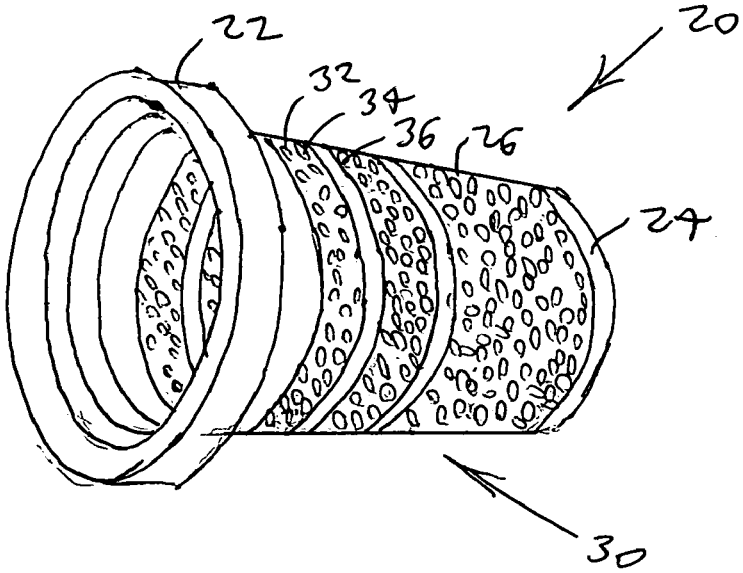
FIG. 8 is a perspective view of an intake chamber similar to that of FIG. 7 except that groups of intake ports are separated by annular closed chamber side wall segments to limit intake toward the chamber discharge end, just as intake ports of smaller diameter toward the chamber discharge end limit intake in that region.
Figure 9:
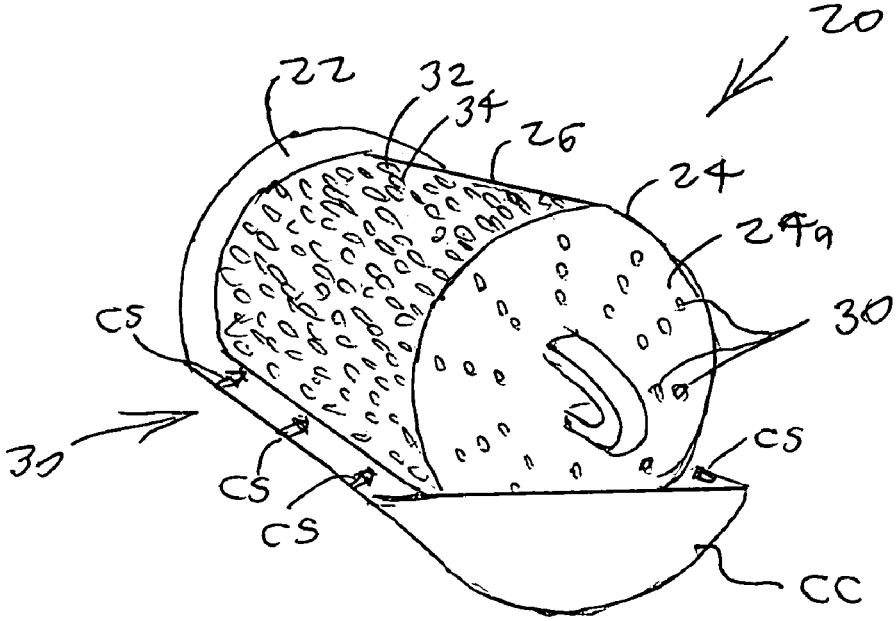
FIG. 9 is an end perspective view of the intake chamber of FIG. 7 having an optional chamber cover CC fitted and secured over the chamber downward surface, so that in the event that the intake chamber rests on the sandy bottom of very shallow water, sand is not drawn into the chamber. The chamber cover CC alternatively or additionally may be fitted and secured over the chamber upward surface, such as when the body of water is so shallow that the intake chamber protrudes above the water surface while resting on the bottom, to prevent intake of air through intake ports in the chamber upward surface. The chamber cover CC preferably includes inwardly protruding barbed cover studs CS which snap into intake ports of the intake chamber to removably fasten the chamber cover over a desired portion of the intake chamber.

Referring to FIGS. 1–9, a liquid gathering and transferring apparatus 10 is disclosed including a liquid intake chamber 20 which preferably is tubular and has a chamber discharge end 22 in fluid communication with a liquid receiving location RL and a chamber structural end 24 opposite the chamber discharge end 22 with a structural end wall 24*a* and a chamber side wall 26 having at least one longitudinal series of liquid intake ports 30 arrayed between the chamber discharge end 22 and the chamber structural end 24 and in fluid communication with liquid at a source location SL, such as a body of water containing debris, at least some among the series of intake ports 32-*n* being of increasing diameter toward chamber structural end 24. See FIG. 1. The number of intake ports provided will vary depending on the intended application and the desired flow capacity of apparatus 10, and thus a fixed and complete series of intake port reference numerals is not provided. More than one longitudinal series of intake ports 32-*n* may be provided in a single chamber side wall 26 laterally adjacent to and parallel to each other. The increase in intake port 32-*n* diameter may or may not be uniform and not be consistently progressive. For example, two or more immediately adjacent intake ports may have substantially the same diameter, and then a subsequent one or more intake ports may have greater diameters. Chamber side wall 26 preferably is tubular. Chamber structural end 24 may be closed, or may include one or more intake ports.

Applicant has determined that one or more arrays of uniformly sized intake ports in an intake chamber 20 extending away from the chamber discharge end 22 produce a large liquid pressure drop between the first set of intake ports 32 and the second set of intake ports 34, and that this pressure drop can produce a vortex. Increasing intake port 32-*n* size in the direction away from the chamber discharge end 22 lowers this pressure drop, significantly reducing or eliminating the possibility of vortex formation.

An intake float structure 70 preferably is provided for buoying the intake chamber 20 to a position below and close to the liquid surface LS, and for orienting the intake ports 32-*n* either toward or away from to the liquid surface LS as desired for the given application. Liquid drawing means 60, which can be a liquid pump, or a syphon or other structure driven by gravity, is provided in fluid communication with the chamber discharge end 22 causing liquid flow into chamber 20 through intake ports 32-*n*. As a result, of the generally increasing intake port diameters away from chamber discharge end 22, apparatus 10 can be suspended a short distance below the surface LS of a body of water, for example, where less debris D is present, and draw water with virtually no vortex formation. The intake port array 30 optionally begins a certain distance from the chamber discharge end 22, defining a closed side wall segment 26*a*.

First Preferred Embodiment

One embodiment of apparatus 10 is intended for drawing water from near the surface LS of a pond, lake, canal or quantity of flood water defining a source location SL. For this embodiment, intake chamber 20 preferably is formed of a substantially rigid material such as polyvinyl chloride (PVC) and intake ports 32-*n* are arrayed along the intake chamber side wall downward portion surface COF. See FIG. 2. An intake float structure 70 as above-referenced is provided. A water transmitting conduit 50, preferably in the form of a flexible hose, extends from the intake chamber discharge end 22 through a water pump 60 to a liquid receiving location RL and is discharged as needed.

The intake float structure 70 preferably includes a buoyant barrier loop 72, within which the intake chamber 20 is mounted diametrically across the interior of the loop 72, for blocking floating debris D from reaching the intake ports 32-*n*. It is preferred for this embodiment that intake chamber 20 include four radial and perpendicular tubular portions extending outwardly from and in mutual fluid communication with a hollow chamber hub portion 28. Intake float structure 70 preferably includes a top panel 74 extending across the upper surface of and thereby closing the barrier loop 72.

Second Preferred Embodiment

A second embodiment of the apparatus 10 is for gathering or "skimming" spilled oil forming an oil layer L floating on the surface LS of a source location body of water SL, which also functions as a boom to contain the oil layer L. Intake float structure 70 includes at least one float tube 82 having a tube closed end 84. The series of intake ports 32-*n* are arrayed along the chamber side wall 26 at the chamber upward surface CUS for drawing oil from layer L downwardly into the chamber 20. The float tube 82 is secured laterally adjacent to the intake chamber side wall 26 with linking lines 86 beside and parallel to an array of intake ports 32-*n* so as not to obstruct the intake ports. Sealant S preferably closes any gap between float tube 82 and chamber side wall 26, so that tube 82 protrudes above the water surface LS and acts as a boom. Buoyant material M is preferably added to chamber upward surface CUS and together within float tube 82 orients the intake ports 32-*n* upwardly, so that the chamber upward surface CUS contacts the oil layer L lower portion. See FIG. 6. Alternatively or in addition to float tube 82, the intake chamber 20 is itself made buoyant either by forming the intake chamber 20 of buoyant material M, or a strip of buoyant material M is attached to the chamber upward surface CUS beside intake ports 32-*n* so that the buoyant material M protrudes upwardly a sufficient distance to function as a boom.

Third Preferred Embodiment

A third embodiment of apparatus 10 is incorporated into and may be treated as including a dam 100 in a stream of water trapping debris D on the water upstream side 110 constituting the source location SL, the apparatus 10 passing only substantially debris-free water to the water downstream side 120 constituting the liquid receiving location RL. See FIG. 5. Once again the combined intake chamber 20 and intake float structure 70 are deployed within the water upstream side 110 source location SL. The transmitting conduit 50 preferably includes a dam pipe 52 passing through the dam 100 from the water upstream side 110 to the water downstream side 120 and opening into downstream side 120 below the level of intake ports 32-*n*, and a flexible hose segment 54 extending from the intake chamber discharge end 24 to the dam pipe 52 so that gravity drives water through the intake chamber 20, through the transmitting conduit 50 and thus through dam 100, to the water downstream side 120. The flexible hose segment 54 permits the intake chamber 20 to rise and fall as necessary to remain a given distance below the liquid surface LS.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A liquid gathering and transferring apparatus for gathering liquid from a liquid source containing a quantity of liquid having a liquid surface and containing debris and discharging the liquid into a liquid receiving location, comprising:

an intake chamber having a chamber discharge end in fluid communication with the liquid receiving location and a chamber structural end opposite said chamber discharge end and a chamber side wall extending between said chamber discharge end and said chamber structural end and at least one longitudinal series of liquid intake ports in said chamber side wall extending generally between said chamber discharge end and said chamber structural end, said intake ports being of generally increasing diameter along said chamber side wall toward said chamber structural end for minimizing liquid vortex formation at said intake ports;

such that said intake chamber can be positioned below the liquid surface at a minimal depth where less debris is present and draw liquid with negligible vortex formation.

2. The apparatus of claim 1, wherein said intake chamber side wall is substantially tubular.

3. The apparatus of claim 1, wherein said intake chamber is oriented in a substantially horizontal position having a chamber downward surface and wherein said intake ports are arrayed along said chamber side wall downward surface and having a chamber upward surface, said apparatus additionally comprising:

a liquid pump in fluid communication with said chamber discharge end;

a liquid transmitting conduit extending from said chamber discharge end to the liquid receiving location;

and buoying means connected to and buoying said intake chamber to a position in which said intake ports are below and substantially adjacent to the liquid surface.

4. The apparatus of claim 3, wherein said liquid transmitting conduit is flexible.

5. The apparatus of claim 3, wherein said buoying means comprises an intake chamber float structure.

6. The apparatus of claim 5, wherein said intake chamber float structure comprises a buoyant barrier loop within which said intake chamber is mounted for blocking floating debris from reaching said intake ports.

7. The apparatus of claim 6, wherein said intake float structure additionally comprises a float structure upper portion and a top panel extending across said float structure upper portion and thereby closing the barrier loop.

8. The apparatus of claim 5, wherein said intake float structure comprises at least one float tube having a float tube closed end and being linked to said intake chamber for positioning said chamber upward surface within a layer of oil on the liquid surface, and wherein said intake ports are arrayed along said chamber upward surface for drawing oil from the layer of oil.

9. The apparatus of claim 8, wherein said intake float structure comprises at least one said float tube which additionally functions as an oil containment boom.

10. The apparatus of claim 3, wherein said buoying means comprises buoyant material secured to said intake chamber such that said intake chamber is made buoyant.

11. A liquid gathering apparatus for gathering liquid from a stream containing a quantity of flowing liquid having a liquid surface and containing debris, comprising:

an intake chamber having a chamber discharge end and a chamber structural end opposite said chamber discharge end and a chamber side wall extending between said chamber discharge end and said chamber structural end and a longitudinal series of liquid intake ports in said chamber side wall extending generally between said chamber discharge end and said chamber structural end, said intake ports being of generally increasing diameters along said chamber side wall toward said chamber structural end for minimizing vortex formation at said intake ports; such that said intake chamber can be suspended below and in close proximity to the liquid surface where less debris is present and draw liquid with substantially no vortex formation;

and a dam extending across and blocking flow of a stream of liquid, said dam having a water upstream side defining the liquid source location and trapping liquid containing debris and having a water downstream side defining a liquid receiving location wherein said intake chamber is positioned on said water upstream side and said chamber discharge end is in fluid communication with the liquid receiving location, and having a liquid transmitting conduit extending through said dam from said water upstream side to said water downstream side and opening into said water downstream side below the level of said intake ports, such that gravity drives water into said intake chamber and through said liquid transmitting conduit and through said dam to said water downstream side;

such that debris is retained within the water upstream side and only substantially debris-free water passes to the water downstream side.

12. The apparatus of claim 11, wherein said liquid transmitting conduit comprises a dam pipe passing through said dam from the water upstream side to the water downstream side and a flexible hose segment extending from said intake chamber to said dam pipe.

* * * * *